US008454210B2

(12) United States Patent
Gu et al.

(10) Patent No.: US 8,454,210 B2
(45) Date of Patent: Jun. 4, 2013

(54) CABLE RECEIVING APPARATUS AND LAMP USING THE SAME

(75) Inventors: Huai-Shan Gu, Shenzhen (CN); Jun Yue, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 228 days.

(21) Appl. No.: 13/114,031

(22) Filed: May 23, 2011

(65) Prior Publication Data

US 2012/0140494 A1 Jun. 7, 2012

(30) Foreign Application Priority Data

Dec. 1, 2010 (CN) ..... 2010 1 0568555

(51) Int. Cl.
*F21V 21/00* (2006.01)
*F21S 8/08* (2006.01)

(52) U.S. Cl.
USPC ..... 362/411; 362/410; 362/382; 362/413; 362/414; 362/433

(58) Field of Classification Search
None
See application file for complete search history.

(56) References Cited

U.S. PATENT DOCUMENTS 6,877,889 B2 * 4/2005 Peng et al. ..... 362/570
7,018,070 B2 * 3/2006 McCoy ..... 362/260

FOREIGN PATENT DOCUMENTS

CN 201137833 Y 10/2008

* cited by examiner

*Primary Examiner* — Natalie Walford
(74) *Attorney, Agent, or Firm* — Altis Law Group, Inc.

(57) ABSTRACT

A cable receiving apparatus include a hollow base defining a through hole, a hollow conduit including a threaded end. The threaded end passes through the through hole and engages a nut to connect the hollow conduit to the hollow base. The threaded end defines a first slot for a cable running through the hollow conduit to enter the hollow base. In this way, during the assembly process, operators can assemble the cable first, then use a socket wrench to screw the nut directly.

11 Claims, 5 Drawing Sheets

CABLE RECEIVING APPARATUS AND LAMP USING THE SAME

BACKGROUND

1. Technical Field

The present disclosure relates to cable receiving apparatus and, particularly, to a lamp with a cable receiving apparatus.

2. Description of Related Art

Many reading lamps or floor lamps often include a conduit encasing the electrical cord. For example, as shown in FIG. 1, a cable 60 runs through one such conduit 10. A base 20 defines a hole (not labeled) in its top. The conduit 10 includes a threaded end 101. The threaded end 101 passes through the hole and is engaged with a nut 40 to fix the conduit 10 on the base 20. A washer 30 is arranged between the nut 40 and the base 20.

During assembly, if an operator were to assemble the cable 60 first, as would be convenient, then a socket wrench 50 used to screw the nut 40 may damage the cable. Therefore, the operator must screw the nut 40 onto the threaded end 101 first, and then assemble the cable 60, which is complicated. Therefore, there is room for improvement in the art.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views, and all the views are schematic.

DETAILED DESCRIPTION

Embodiments of the present disclosure are now described in detail, with reference to the accompanying drawings.

Figure 1:
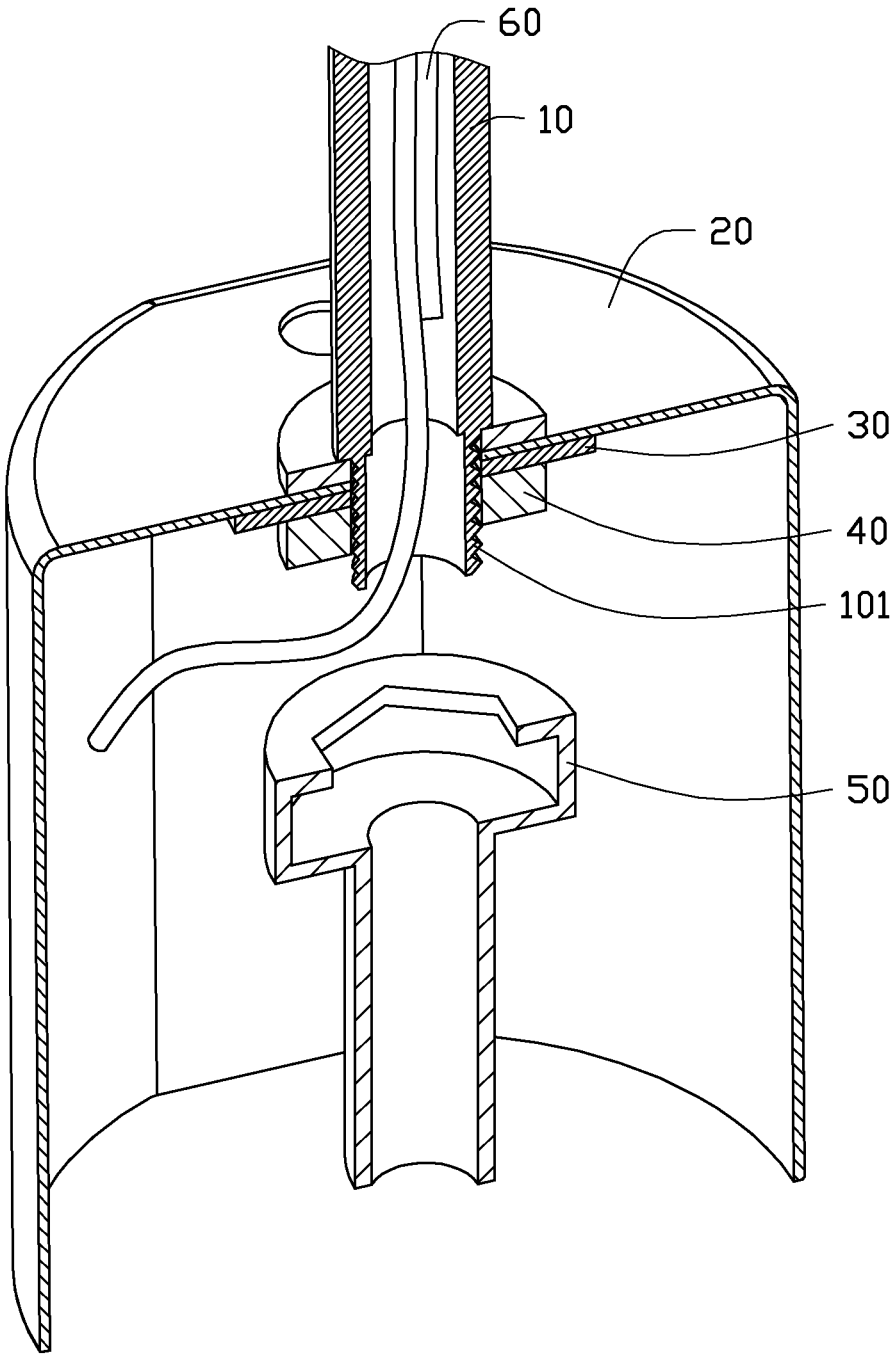
FIG. 1 (RELATED ART)
FIG. 1 is a cross-sectional view showing a conventional conduit cable receiving apparatus.
Figure 2:
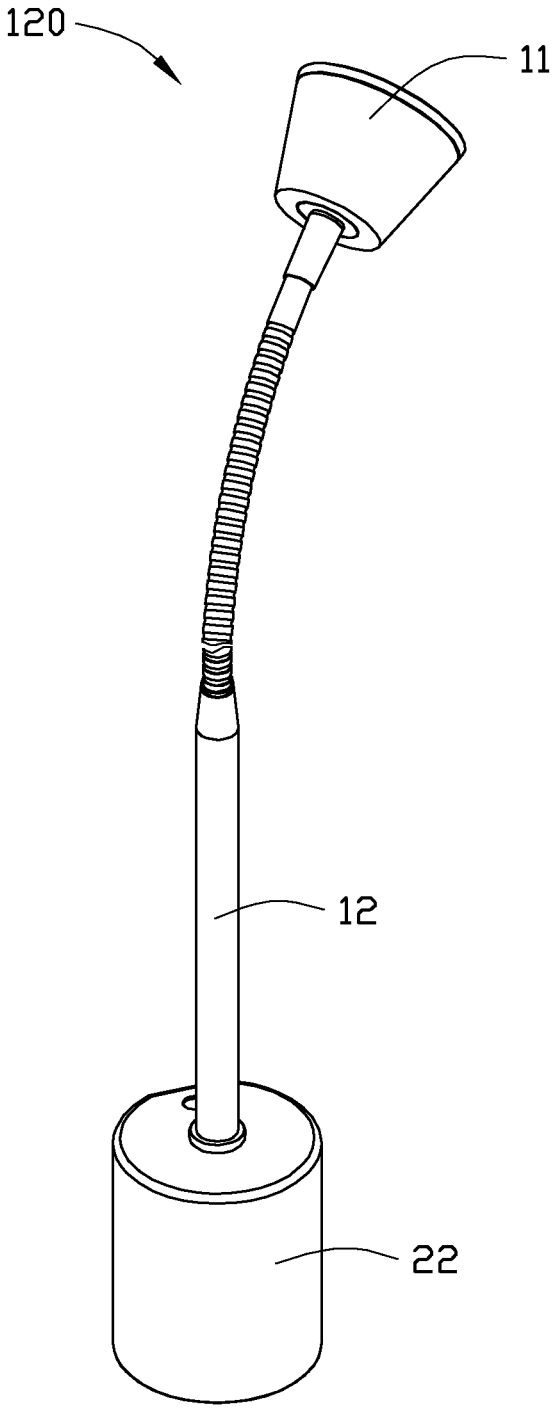
FIG. 2 is an assembled, isometric view of an LED lamp in accordance with a first embodiment.

Referring to FIG. 2, an embodiment of a lamp 120 is illustrated. The lamp 120 includes a bulb 11, a conduit 12, and a base 22. The bulb 11 and the base 22 are attached at opposite ends of the conduit 12. A driving circuit (not shown) is accommodated in the base 22, and is used to electrically connected to the bulb 11 and a power source (not shown).

Figure 3:
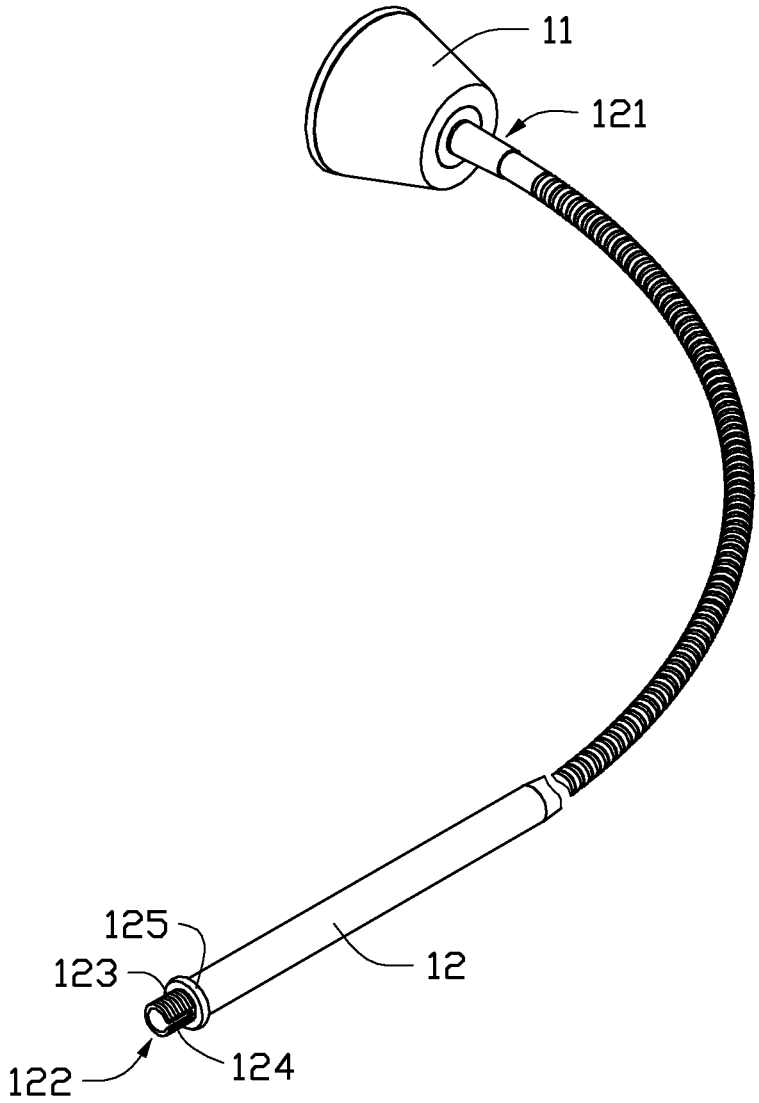
FIG. 3 is a schematic view of a conduit and a bulb of the LED lamp of FIG. 2.

Referring to FIG. 3, the conduit 12 includes a first end 121 and a second, opposite end 122. The first end 121 is attached to the bulb 11. An external thread 123 is formed on the second end 122 of the conduit 12. A first slot 124 is defined in the lateral surface of the second end 122 and extends along the lengthwise direction of the second end 122. A flange 125 is arranged around the lateral surface of the conduit 12 away from the distal end of the external thread 123.

Figure 4:
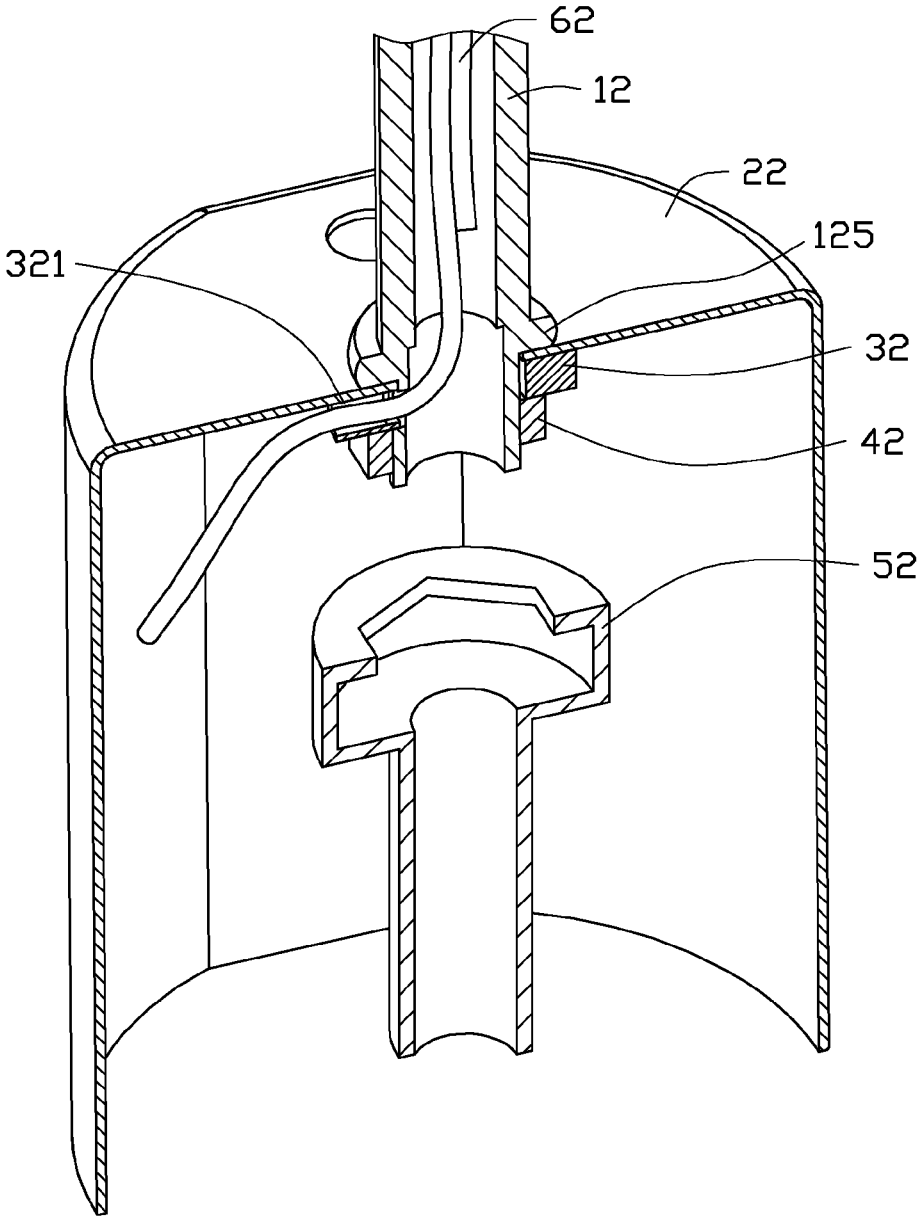
FIG. 4 is a cross-sectional view showing a conduit of a cable receiving apparatus of the LED lamp of FIG. 2.
Figure 5:
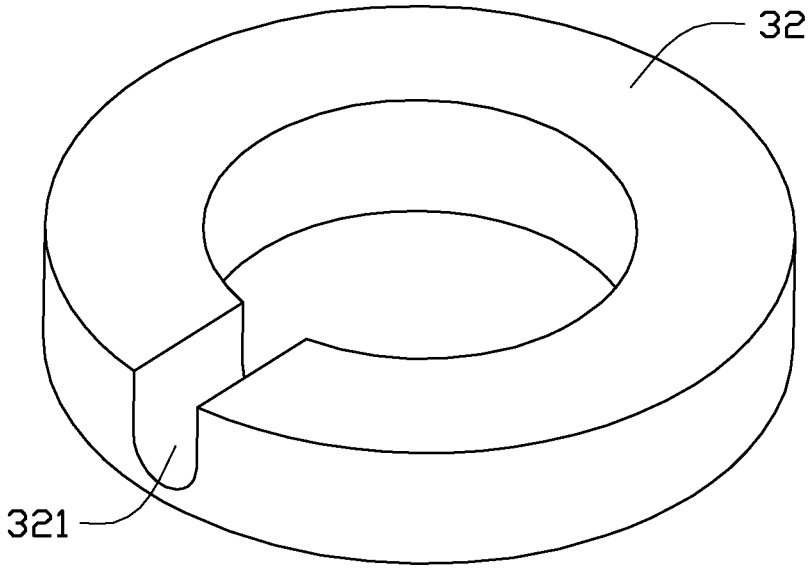
FIG. 5 is a schematic view of a washer of the LED lamp of FIG. 2.

Referring to FIG. 4, the base 22 is a hollow case and defines a through hole 221 in its top. The through hole 221 has a diameter smaller than the diameter of the back plate 125. The second end 122 passes through the hole 221 and the flange 125 presses against the top of the base 22. A nut 42 is screwed on the second end 122 to fix the conduit 12 to the base 22. Furthermore, a washer 32 is arranged between the nut 42 and the base 22 (see FIG. 5). The washer 32 defines a second slot 321 extending in a direction substantially perpendicular to an extending direction of the first slot 124, and the washer 32 is positioned in such a manner that the second slot 321 is aligned with the first slot 124 of the conduit 12 for the cable 62 to pass through and enter the hollow base 22. The washer 32 can be made of rubber or a metal.

As shown in FIG. 4, a portion of the cable 62 is received in the conduit 12, a small mediate portion extends through the first slot 124 of the conduit 12 and the second slot 321 of the washer 32, and the remainder is received in the base 22. During assembly, operators can assemble the cable 62 first, then use a socket wrench 52 to screw the nut 42 directly. The cable 62, entering the base 22 through the first slot 124 and the washer 32, will not block the wrench 52. In this way, the assembly process is greatly simplified.

It is to be understood, however, that even though numerous characteristics and advantages of the present disclosure have been set forth in the foregoing description, together with details of the structure and function of the present disclosure, the present disclosure is illustrative only, and changes may be made in detail, especially in matters of shape, size, and arrangement of parts within the principles of the present disclosure to the full extent indicated by the broad general meaning of the terms in which the appended claims are expressed.

What is claimed is:

1. A cable receiving apparatus, comprising:

a hollow base defining a through hole;

a conduit comprising a threaded end, the threaded end passing through the through hole and engaging a nut to connect the conduit to the hollow base, the threaded end defining a first slot for a cable running through the conduit to enter the hollow base.

2. The cable receiving apparatus according to claim 1, wherein a washer is arranged between the nut and the base.

3. The cable receiving apparatus according to claim 2, wherein the washer defines a second slot extending in a direction substantially perpendicular to an extending direction of the first slot, and the washer is positioned in such a manner that the second slot is aligned with the first slot of the conduit for the cable to pass through and enter the hollow base.

4. The cable receiving apparatus according to claim 2, wherein the washer is made of rubber.

5. The cable receiving apparatus according to claim 2, wherein the washer is made of metal.

6. The cable receiving apparatus according to claim 1, wherein a flange is arranged around the lateral surface of the threaded end and away from the distal end of the threaded end.

7. A hollow conduit for receiving cable comprising a threaded end, the threaded end defining a slot for a cable running through the hollow conduit to come out.

8. A lamp, comprising:

a bulb;

a hollow base defining a through hole;

a conduit comprising a threaded end, the threaded end passing through the through hole and engaging a nut to connect the conduit to the base, the threaded end defining a first slot for a cable running through the conduit to enter the hollow base;

a driving circuit accommodating in the hollow base and configured to electrically connected to the bulb.

9. The lamp according to claim 8, wherein a washer is arranged between the nut and the base.

10. The lamp according to claim 9, wherein the washer defines a second slot extending in a direction substantially perpendicular to an extending direction of the first slot, and the washer is positioned in such a manner that the second slot is aligned with the first slot of the conduit for the cable to pass through and enter the hollow base.

11. The lamp according to claim 8, wherein a flange is arranged around the lateral surface of the threaded end and away from the distal end of the threaded end.

* * * * *